US009348262B1

(12) United States Patent
Suenami

(10) Patent No.: US 9,348,262 B1
(45) Date of Patent: May 24, 2016

(54) DEVELOPING DEVICE HAVING DEVELOPER SUPPLY PORT AND DEVELOPER DISCHARGE PORT, AND IMAGE FORMING APPARATUS THEREWITH

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/962,550

(22) Filed: Dec. 8, 2015

(30) Foreign Application Priority Data

Feb. 19, 2015 (JP) ..... 2015-030250

(51) Int. Cl.
*G03G 15/08* (2006.01)
*G03G 21/10* (2006.01)

(52) U.S. Cl.
CPC ..... *G03G 15/0889* (2013.01); *G03G 15/0812* (2013.01); *G03G 15/0893* (2013.01); *G03G 21/10* (2013.01); *G03G 2215/083* (2013.01)

(58) Field of Classification Search
CPC ..... G03G 15/0812; G03G 21/10; G03G 2215/0607; G03G 2215/0819; G03G 15/0889; G03G 15/0891; G03G 15/0893; G03G 2215/0802; G03G 2215/083; G03G 2215/0838
See application file for complete search history.

(56) References Cited

U.S. PATENT DOCUMENTS

2012/0189349 A1* 7/2012 Okuno ..... G03G 15/0189 399/254

FOREIGN PATENT DOCUMENTS

JP 2001-265098 A 9/2001
JP 2005221852 A * 8/2005

* cited by examiner

*Primary Examiner* — David Gray
*Assistant Examiner* — Laura Roth
(74) *Attorney, Agent, or Firm* — Stein IP, LLC

(57) ABSTRACT

A developing device has a developer container, first and second stirring members, a developer carrier, a developer supply port, and a developer discharge port. The developer container has transport chambers including the first and second transport chambers, and communication portions through which the first and second transport chambers mutually communicate. The first stirring member has a rotary shaft and a first helical blade. The second stirring member has a rotary shaft and a second helical blade. The second stirring member has a regulating portion for regulating movement of developer toward the developer discharge port. The regulating portion has two or more turns of regulating blades spiraling in the opposite phase to the second helical blade. The gap between the regulating blades and the inner wall surface of the developer container is gradually small from upstream to downstream with respect to the developer transport direction in the second transport chamber.

4 Claims, 4 Drawing Sheets

DEVELOPING DEVICE HAVING DEVELOPER SUPPLY PORT AND DEVELOPER DISCHARGE PORT, AND IMAGE FORMING APPARATUS THEREWITH

INCORPORATION BY REFERENCE

This application is based upon and claims the benefit of priority from the corresponding Japanese Patent Application No. 2015-030250 filed on Feb. 19, 2015, the entire contents of which are incorporated herein by reference.

BACKGROUND

The present disclosure relates to a developing device incorporated in an image forming apparatus exploiting electrophotography, such as a copier, a printer, a facsimile machine, a multifunction peripheral thereof, etc., and to an image forming apparatus incorporating the developing device. More particularly, the present disclosure relates to a developing device which can be replenished with new two-component developer containing toner and carrier and meanwhile discharge surplus developer, and to an image forming apparatus incorporating such a developing device.

In an image forming apparatus, an electrostatic latent image formed on an image carrier comprising a photosensitive member or the like is made visible by being developed into a toner image by a developing device. Some such developing devices adopt a two-component developing system that uses two-component developer. In this type of developing device, two-component developer containing carrier and toner is stored in a developer container, there is provided a developer roller which feeds the developer to the image carrier, and there is provided a stirring member which transports, while stirring, the developer in the developer container to feed it to the developer roller.

In the developing device, toner is consumed in developing operation, whereas carrier is left unconsumed in the developing device. Thus, carrier stirred together with toner in the developer container deteriorates under mechanical stress as the carrier is stirred repeatedly, gradually diminishing the toner charging performance of the carrier.

As a solution, developing devices have been proposed that can replenish a toner container with new developer containing carrier and toner and that can meanwhile discharge surplus developer.

For example, a developing device is known in which two stirring members each composed of a rotary shaft and a helical blade formed in a helical shape on a circumferential surface of the rotary shaft are arranged parallel in transport chambers respectively. In the developing device, a partition portion is provided between the transport chambers, and in opposite end parts of the partition portion respectively, communication portions through which developer is delivered are provided. Moreover, a developer discharge port is formed on the downstream side of the transport chamber with respect to the developer transport direction. Between the stirring member and the developer discharge port, a reverse helical blade formed in a helical shape spiraling in the opposite direction to the helical blade of the stirring member is provided as a regulating portion integrally with the rotary shaft.

In this configuration, as new developer is supplied into the developer container, the developer is, while being stirred, transported to the downstream side of the transport chamber by rotation of the stirring members. As the reverse helical blade rotates in the same direction as the stirring member, by the reverse helical blade, a transport force is applied to the developer in the opposite direction to the developer transport direction by the stirring member. By the transport force in the opposite direction, the developer is blocked on the downstream side of the transport chamber, and increases its height; thus surplus developer moves over the reverse helical blade (regulating portion) to the developer discharge port and is discharged to the outside. In this way, it is possible to refresh the developer container with new developer while keeping the height of the developer in it.

SUMMARY

According to one aspect of the present disclosure, a developing device includes a developer container, first and second stirring members, a developer carrier, a developer supply port, and a developer discharge port. The developer container has a plurality of transport chambers including first and second transport chambers arranged parallel to each other, and communication portions through which the first and second transport chambers communicate with each other at opposite side end parts thereof in the longitudinal direction, and contains two-component developer containing carrier and toner. The first stirring member is composed of a rotary shaft and a first helical blade formed on a circumferential surface of the rotary shaft, and stirs and transports the developer in the first transport chamber in the axial direction of the rotary shaft. The second stirring member is composed of a rotary shaft and a second helical blade formed on a circumferential surface of the rotary shaft, and stirs and transports the developer in the second transport chamber in the opposite direction to the first stirring member. The developer carrier is rotatably supported on the developer container, and carries on its surface the developer in the second transport chamber. Through the developer supply port, the developer is supplied into the developer container. The developer discharge port is arranged in a downstream-side end part of the second chamber with respect to the developer transport direction in the second transport chamber, and through the developer discharge port, surplus developer is discharged. The second stirring member has a regulating portion formed on it which is arranged opposite the developer discharge port on a downstream side of the communication portion with respect to the developer transport direction in the second transport chamber, and which regulates movement of the developer toward the developer discharge port. The regulating portion is composed of two or more turns of regulating blades spiraling in the opposite phrase to the second helical blade, and a gap between the regulating blade and the inner wall surface of the developer container is gradually small from upstream to downstream with respect to the developer transport direction in the second transport chamber.

Further features and advantages of the present disclosure will become apparent from the description of embodiments given below.

DETAILED DESCRIPTION

Figure 1:
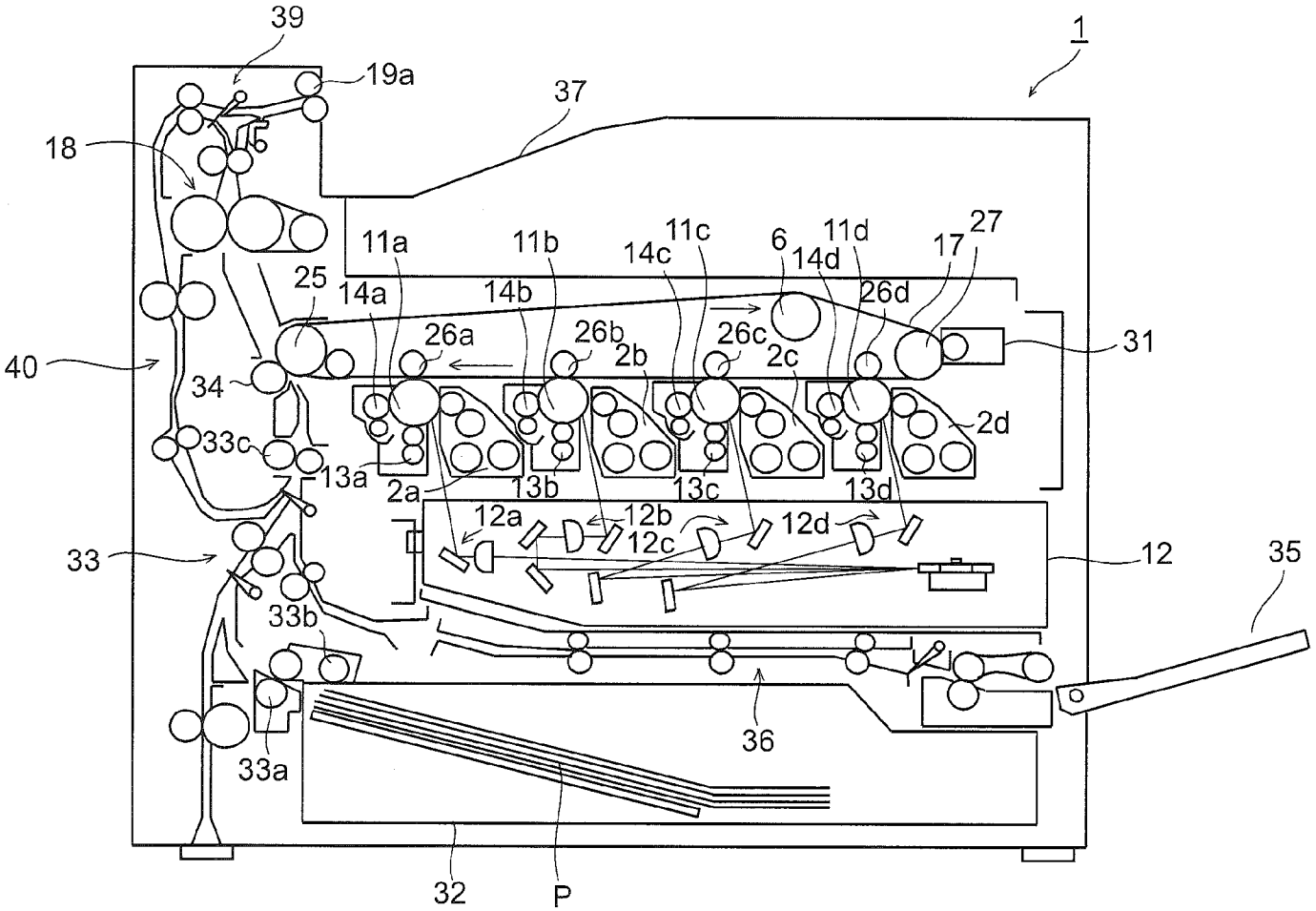
FIG. 1 is a sectional view schematically showing an overall construction of an image forming apparatus 1 incorporating developing devices 2*a* to 2*d* according to the present disclosure.

Hereinafter, embodiments of the present disclosure will be described with reference to the accompanying drawings. FIG. 1 is a sectional view schematically showing a construction of an image forming apparatus 1 incorporating developing devices 2*a* to 2*d* according to the present disclosure. The image forming apparatus 1 is a tandem-type color printer. Rotatable photosensitive drums 11*a* to 11*d* comprise, for example, organic photosensitive members (OPC) on which an organic photosensitive layer is formed or amorphous silicon photosensitive members on which an amorphous silicon photosensitive layer is formed, and are arranged so as to correspond to different colors, namely black, yellow, cyan, and magenta respectively. Around the photosensitive drums 11*a* to 11*d* respectively, there are arranged developing devices 2*a* to 2*d*, an exposure unit 12, charging units 13*a* to 13*d*, and cleaning devices 14*a* to 14*d*.

The developing devices 2*a* to 2*d* are arranged beside (in FIG. 1, on the right side of) the photosensitive drums 11*a* to 11*d*, opposite them respectively, and feed toner to the photosensitive drums 11*a* to 11*d*. The charging units 13*a* to 13*d* are arranged on the upstream side of the developing devices 2*a* to 2*d* with respect to the rotation direction (the counter-clockwise direction in FIG. 1) of the photosensitive drums 11*a* to 11*d*, opposite the surfaces of the photosensitive drums 11*a* to 11*d* respectively, and electrostatically charge the surfaces of the photosensitive drums 11*a* to 11*d* uniformly.

The exposure unit 12 is for scanning the photosensitive drums 11*a* to 11*d* to expose them to light based on the image data containing characters, and patterns, and the like entered in an image input unit (unillustrated) from a personal computer or the like, and is arranged under the developing devices 2*a* to 2*d*. In the exposure unit 12, a laser light source and a polygon mirror are provided, and for each of the photosensitive drums 11*a* to 11*d*, a reflection mirror and a lens corresponding are provided. Laser light emitted from the laser light source is shone, via the polygon mirror, the reflection mirror, and the lens, on to the surfaces of the photosensitive drums 11*a* to 11*d* from the downstream side of the charging units 13*a* to 13*d* with respect to the rotation direction of the photosensitive drums 11*a* to 11*d*. By the laser light thus shone, electrostatic latent images are formed on each the surfaces of the photosensitive drums 11*a* to 11*d*, and these electrostatic latent images are developed into toner images by the developing devices 2*a* to 2*d*.

An endless intermediate transfer belt 17 is wound, under tension, around a tension roller 6, a driving roller 25, and a following roller 27. The driving roller 25 is driven to rotate by an unillustrated motor and the intermediate transfer belt 17 is driven to rotate in the clockwise direction in FIG. 1 by the rotation of the driving roller 25.

The photosensitive drums 11*a* to 11*d* are arranged under the intermediate transfer belt 17, next to each other in the traveling direction of the belt (in the direction indicated by an arrow in FIG. 1), so as to make contact with the intermediate transfer belt 17. Primary transfer rollers 26*a* to 26*d* are arranged opposite the photosensitive drums 11*a* to 11*d* respectively across the intermediate transfer belt 17, and are kept in pressed contact with the intermediate transfer belt 17, thereby forming a primary transfer portion. In the primary transfer portion, as the intermediate transfer belt 17 rotates, the toner images on the photosensitive drums 11*a* to 11*d* are transferred sequentially to the intermediate transfer belt 17 with predetermined timing. In this way, on the surface of the intermediate transfer belt 17, the toner images of four colors, namely cyan, magenta, yellow, and black, superimposed on each other to form a full color toner image.

A secondary transfer roller 34 is arranged opposite the driving roller 25 across the intermediate transfer belt 17, and is kept in pressed contact with the intermediate transfer belt 17, thereby forming a secondary transfer portion. In the secondary transfer portion, the toner images on the surface of the intermediate transfer belt 17 are transferred to a sheet of paper P. After the transfer, a belt cleaning device 31 removes toner left behind on the surface of the intermediate transfer belt 17.

In a lower part of the image forming apparatus 1, a paper feed cassette 32 is arranged for storing the paper P, and at the right side of the paper feed cassette 32, a stack tray 35 is arranged for manual paper feeding. At the left side of the paper feed cassette 32, a first paper transport passage 33 is arranged through which the paper P fed from the paper feed cassette 32 is transported to the secondary transfer portion on the intermediate transfer belt 17. At the left side of the stack tray 35, a second paper transport passage 36 is arranged through which the paper fed from the stack tray 35 is transported to the second transfer portion. Moreover, in an upper left part of the image forming apparatus 1, a fixing portion 18 where the paper P having the image formed on it is subjected to fixing, and a third paper transport passage 39 through which the paper having undergone fixing is transported to a paper discharging portion 37.

The paper feed cassette 32 can be refilled with paper when pulled (toward the front in FIG. 1) out of the device. The paper P stored in the paper feed cassette 32 is fed one sheet after another toward the first paper transport passage 33 by a pick-up roller 33*b* and a separating roller 33*a*.

The first paper transport passage 33 joins the second paper transport passage 36 short of a registration roller pair 33*c*. The registration roller pair 33*c*, while adjusting the timing of image formation on the intermediate transfer belt 17 and paper feeding, transports the paper P to the secondary transfer portion. To the paper P transported to the secondary transfer portion, the full color toner image on the intermediate transfer belt 17 is secondarily transferred by the secondary transfer roller 34 to which a bias potential is applied, and the paper P is then transported to the fixing portion 18.

The fixing portion 18 is provided with a fixing belt which is heated by a heat roller, a fixing roller which makes contact with the fixing belt from inside, and a pressure roller which is arranged in pressed contact with the fixing roller across the fixing belt, etc. The fixing portion 18 applies heat and pressure to the paper P having the toner images transferred to it, and thereby achieves fixing. After the toner images are fixed to the paper P in the fixing portion 18, the paper P is reversed as necessary in a fourth paper transport passage 40 so that toner images are secondarily transferred also to the reversed side of the paper and are then fixed in the fixing portion 18. The paper having the toner images have fixed to it is discharged through the third paper transport passage 39 onto the paper discharging portion 37 by a discharging roller 19*a*.

Figure 2:
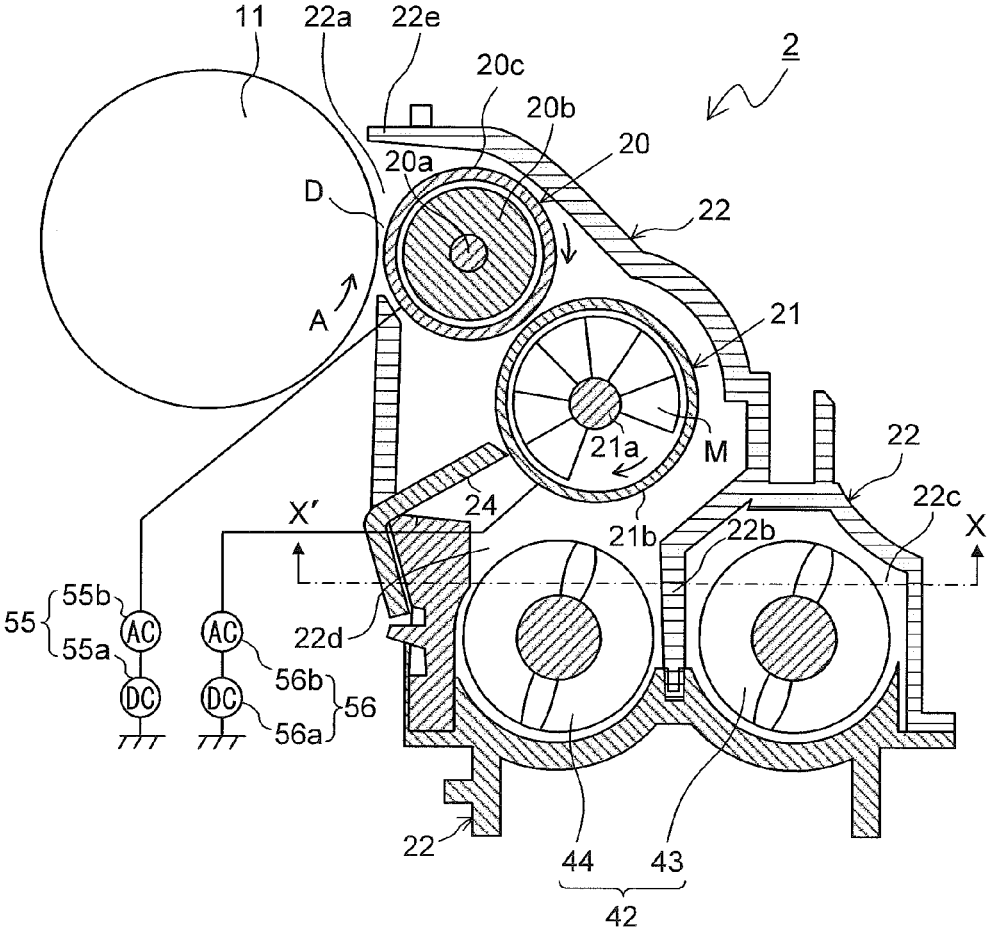
FIG. 2 is a side sectional view of a developing device 2 according to one embodiment of the present disclosure.

FIG. 2 is a side sectional view showing a structure of a developing device 2 incorporated in the above-described image forming apparatus 1. While the following description deals with the structure and operation of the developing device 2*a* corresponding to the photosensitive drum 11*a* shown in FIG. 1, the structure and operation of the developing devices 2*b* to 2*d* are similar to those of the developing device 2*a*, and therefore no overlapping description will be repeated. Moreover, the suffixes "a" to "d" distinguishing the developing devices and the photosensitive members for different colors will be omitted.

As shown in FIG. 2, the developing device 2 includes a developing roller 20, a magnetic roller 21, a regulating blade 24, a stirring member 42, a developer container 22, etc.

The developer container 22 forms the housing of the developing device 2, and is divided, in a lower part of it, into a first transport chamber 22*c* and a second transport chamber 22*d* by a partition portion 22*b*. In the first transport chamber 22*c* and the second transport chamber 22*d*, developer containing carrier and toner (here, positively charged toner) is stored. The developer container 22 rotatably holds the stirring member 42, the magnetic roller 21, and the developing roller 20. In the developer container 22, an opening 22*a* is formed through which the developing roller 20 is exposed toward the photosensitive drum.

The developing roller 20 is arranged opposite the photosensitive drum across a predetermined distance, on the right side of the photosensitive drum. The developing roller 20 forms, at a position opposite and close to the photosensitive drum, a developing region D where toner is fed to the photosensitive drum. The magnetic roller 21 is arranged opposite the developing roller 20 across a predetermined distance, obliquely on the lower right side of the developing roller 20. The magnetic roller 21 feeds toner to the developing roller 20 at a position opposite and close to the developing roller 20. The stirring member 42 is arranged largely under the magnetic roller 21. The regulating blade 24 is fixedly held on the developer container 22, obliquely on the lower left side of the magnetic roller 21.

The stirring member 42 is composed of two spirals, namely a first spiral 43 and a second spiral 44. The second spiral 44 is arranged under the magnetic roller 21, in the second transport chamber 22*d*. The first spiral 43 is arranged next to, on the right side of, the second spiral 44, in the first transport chamber 22*c*.

The first and second spirals 43 and 44, while stirring developer, electrostatically charge the toner contained in the developer up to a predetermined level. This allows the toner to be held on the carrier. Communication portions (unillustrated) are provided in opposite longitudinal-direction (the front/rear direction with respect to the plane of FIG. 2) end parts of the partition portion 22*b* which separates the first transport chamber 22*c* and the second transport chamber 22*d*. As the first spiral 43 rotates, the charged developer is transported to the second spiral 44 via one of the communication portions provided in the partition portion 22*b*, so that the developer circulates through the first transport chamber 22*c* and the second transport chamber 22*d*. Then, the developer is fed from the second spiral 44 to the magnetic roller 21.

The magnetic roller 21 is composed of a roller shaft 21*a*, a magnetic pole member M, and a non-magnetic sleeve 21*b* formed of a non-magnetic material. The magnetic roller 21 carries the developer fed from the stirring member 42, and feeds, out of the developer carried, the toner alone to the developing roller 20. The magnetic pole member M has a plurality of magnets, which are each formed to have a fan-shaped section and which have on their peripheral parts different magnetic polarities from one to the next, arranged alternately. The magnetic pole member M is adhered or otherwise fixed to the roller shaft 21*a*. The roller shaft 21*a* is unrotatably supported on the developer container 22 in the non-magnetic sleeve 21*b*, with a predetermined distance between the magnetic pole member M and the non-magnetic sleeve 21*b*. The non-magnetic sleeve 21*b* rotates in the same direction (the clockwise direction in FIG. 2) as the developing roller 20 by the action of a driving mechanism comprising a motor and gears, of which none is illustrated. To the non-magnetic sleeve 21*b*, a bias 56 having an AC voltage 56*a* superimposed on a DC voltage 56*b* is applied. On the surface of the non-magnetic sleeve 21*b*, the charged developer is carried in the form of a magnetic brush by the magnetic force of the magnetic pole member M. The magnetic brush is adjusted to have a predetermined height by the regulating blade 24.

As the non-magnetic sleeve 21*b* rotates, the magnetic brush is transported while being carried on the surface of the non-magnetic sleeve 21*b* by the magnetic pole member M. When the magnetic brush makes contact with the developing roller 20, the toner alone out of the magnetic brush is fed to the developing roller 20 according to the bias 56 applied to the non-magnetic sleeve 21*b*.

The developing roller 20 is composed of a fixed shaft 20*a*, a magnetic pole member 20*b*, a developing sleeve 20*c* formed of a non-magnetic metal material in a cylindrical shape, etc.

The fixed shaft 20*a* is unrotatably supported on the developer container 22. Around the fixed shaft 20*a*, the developing sleeve 20*c* is rotatably held. Moreover, to the fixed shaft 20*a*, the magnetic pole member 20*b* comprising a magnet is adhered or otherwise fixed at a position opposite the magnetic roller 21, at a predetermined distance from the developing sleeve 20*c*. The developing sleeve 20*c* rotates in the direction indicated by an arrow in FIG. 2 (the clockwise direction) by the action of a driving mechanism comprising a motor and gears, of which none is illustrated. To the developing sleeve 20*c*, a developing bias 55 having an AC voltage 55*a* superimposed on a DC voltage 55*b* is applied.

As the developing sleeve 20*c* to which the developing bias 55 is applied rotates in the clockwise direction in FIG. 2, in the developing region D, due to the potential difference between the developing bias and the exposed part of the photosensitive drum, toner carried on the surface of the developing sleeve 20*c* flies to the photosensitive drum 11. The flying toner attaches, sequentially, to the exposed part on the photosensitive drum 11 rotating in the direction indicated by arrow A (the counter-clockwise direction), and thus the electrostatic latent image on the photosensitive drum 11 is developed.

Figure 3:
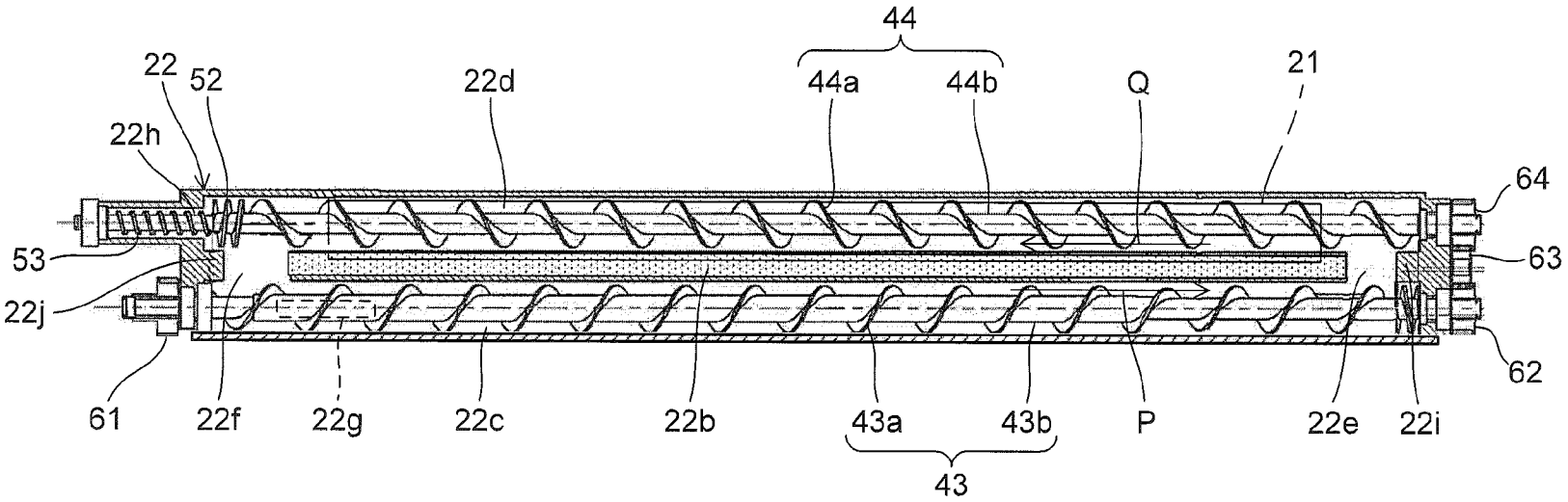
FIG. 3 is a sectional plan view of a stirring portion in a developing device 2 according to one embodiment of the present disclosure.

Now, a stirring portion in the developing device 2 will be described in detail with reference to FIG. 3. FIG. 3 is a sectional plan view (as taken across line X-X' in FIG. 2) of the stirring portion in the developing device 2.

In the developer container 22, as described previously, there are formed a first transport chamber 22*c*, a second transport chamber 22*d*, a partition portion 22*b*, an upstream-side communication portion 22*e*, and a downstream-side communication portion 22*f*. In the developer container 22, there are further formed a developer supply port 22*g*, a developer discharge port 22*h*, an upstream-side wall portion 22*i*, and a downstream-side wall portion 22*j*. With respect to the first transport chamber 22*c*, the left side in FIG. 2 is the upstream side and the right side in FIG. 2 is the downstream side; with respect to the second transport chamber 22*d*, the right side in FIG. 2 is the upstream side and the left side in FIG. 2 is the downstream side. Thus, the communication portions and the side wall portions are distinguished between the upstream-side and downstream-side ones relative to the second transport chamber 22*d*.

The partition portion 22*b* extends in the longitudinal direction of the developer container 22 to separate the first transport chamber 22*c* and the second transport chamber 22*d* parallel to each other. On one hand, the right side end part of the partition portion 22*b* in the longitudinal direction forms the upstream-side communication portion 22*e* together with the inner wall part of the upstream-side wall portion 22*i*. On the other hand, the left side end part of the partition portion 22*b* in the longitudinal direction forms the downstream-side communication portion 22*f* together with the inner wall part of the downstream-side wall portion 22*j*. Thus, developer can circulate through the first transport chamber 22*c*, the upstream-side communication portion 22*e*, the second transport chamber 22*d*, and the downstream-side communication portion 22*f*.

The developer supply port 22*g* is a port through which new developer and carrier are supplied from a developer supply container (unillustrated) provided over the developer container 22 into the developer container 22. The developer supply port 22*g* is arranged on the upstream side (the left side in FIG. 2) of the first transport chamber 22*c*.

The developer discharge port 22*h* is a port through which surplus developer in the first and second transport chambers 22*c* and 22*d* resulting from supply of new developer is discharged. The developer discharge port 22*h* is arranged continuous with the second transport chamber 22*d* in the longitudinal direction on the downstream side of the second transport chamber 22*d*.

In the first transport chamber 22*c*, the first spiral 43 is arranged; in the second transport chamber 22*d*, the second spiral 44 is arranged.

The first spiral 43 has a rotary shaft 43*b* and a first helical blade 43*a* provided integrally with the rotary shaft 43*b* and formed in a helical shape with a predetermined pitch in the axial direction of the rotary shaft 43*b*. The first helical blade 43*a* extends up to opposite side end parts of the first transport chamber 22*c* in the longitudinal direction, and is arranged so as to face the upstream-side and downstream-side communication portions 22*e* and 22*f*. The rotary shaft 43*b* is rotatably supported on the upstream-side wall portion 22*i* and the downstream-side wall portion 22*j* of the developer container 22.

The second spiral 44 has a rotary shaft 44*b* and a second helical blade 44*a* provided integrally with the rotary shaft 44*b* and formed in a helical shape spiraling in the opposite direction (in the opposite phase) to the first helical blade 43*a* with the same pitch as the first helical blade 43*a* in the axial direction of the rotary shaft 44*b*. The second helical blade 44*a* has a length larger than that of the magnetic roller 21 in the axial direction, and is arranged so as to extend up to a position facing the upstream-side communication portion 22*e*. The rotary shaft 44*b* is arranged parallel to the rotary shaft 43*b* and is rotatably supported on the upstream-side wall portion 22*i* and the downstream-side wall portion 22*j* of the developer container 22.

Moreover, on the rotary shaft 44*b*, a regulating portion 52 and a discharge blade 53 are integrally arranged together with the second helical blade 44*a*.

The regulating portion 52 makes it possible to block the developer transported to the downstream side inside the second transport chamber 22*d* and to transport the developer to the developer discharge port 22*h* when the amount of developer exceeds a predetermined amount. The regulating portion 52 comprises a helical blade (regulating blade) provided on the rotary shaft 44*b*, and is formed in a helical shape spiraling in the opposite direction (in the opposite phase) to the second helical blade 44*a*. The regulating portion 52 is configured to have substantially the same outer diameter as, but a smaller pitch than, the second helical blade 44*a*. The circumferential portion of the regulating portion 52 has a predetermined gap (clearance) secured from the inner wall portion (the downstream-side wall portion 22*j*) of the developer container 22. The surplus developer is discharged through the gap.

The rotary shaft 44*b* extends into the developer discharge port 22*h*. On the rotary shaft 44*b* in the developer discharge port 22*h*, the discharge blade 53 is provided. The discharge blade 53 comprises a blade spiraling in the same direction as the second helical blade 44*a*, but has a smaller pitch and a smaller blade circumference than those of the second helical blade 44*a*. Thus, as the rotary shaft 44*b* rotates, the discharge blade 53 also rotates so that the surplus developer transported into the developer discharge port 22*h* over the regulating portion 52 is transported to the left side in FIG. 3 to be discharged out from the developer container 22. The discharge blade 53, the regulating portion 52, and the second helical blade 44*a* are formed integrally with the rotary shaft 44*b* out of synthetic resin.

On an outer wall of the developer container 22, gears 61 to 64 are arranged. The gears 61 and 62 are fixed on the rotary shaft 43*b*; the gear 64 is fixed on the rotary shaft 44*b*; and the gear 63 is rotatably held on the developer container 22 to mesh with the gears 62 and 64.

During development, during which no new developer is supplied, as the gear 61 rotates by the action of a driving source such as a motor, the first helical blade 43*a* rotates together with the rotary shaft 43*b*. By the first helical blade 43*a*, developer in the first transport chamber 22*c* is transported in the direction indicated by arrow P, and the developer is then transported through the upstream-side communication portion 22*e* into the second transport chamber 22*d*. Moreover, as the second helical blade 44*a* rotates together with the rotary shaft 44*b* which follows the gear 64, by the second helical blade 44*a*, the developer in the second transport chamber 22*d* is transported in the direction indicated by arrow Q. Thus, the developer is, while greatly varying its height, transported from the first transport chamber 22*c* through the upstream-side communication portion 22*e* into the second transport chamber 22*d*, and the developer is then, without going over the regulating portion 52, transported through the downstream-side communication portion 22*f* to the first transport chamber 22*c*.

In this way, developer circulates through, while being stirred, the first transport chamber 22*c*, the upstream-side communication portion 22*e*, the second transport chamber 22*d*, and the downstream-side communication portion 22*f*, and the stirred developer is fed to the magnetic roller 21.

Now, how developer is supplied through the developer supply port 22*g* will be described. As toner is consumed in development, developer containing toner and carrier is supplied through the developer supply port 22*g* into the first transport chamber 22*c*.

The supplied developer is, as during development, transported in the direction indicated by arrow P inside the first transport chamber 22*c* by the first helical blade 43*a*, and the developer is then transported through the upstream-side communication portion 22*e* into the second transport chamber 22*d*. Moreover, by the second helical blade 44*a*, the developer in the second transport chamber 22*d* is transported in the direction indicated by arrow Q. As the regulating portion 52 rotates together with the rotary shaft 44*b*, a transporting force in the direction opposite to the developer transport direction ascribable to the second helical blade 44*a* is applied to the developer by the regulating portion 52. The developer increases its height by being blocked by the regulating portion 52, and the surplus developer is discharged over the regulating portion 52 via the developer discharge port 22*h* out of the developer container 22.

Figure 4:
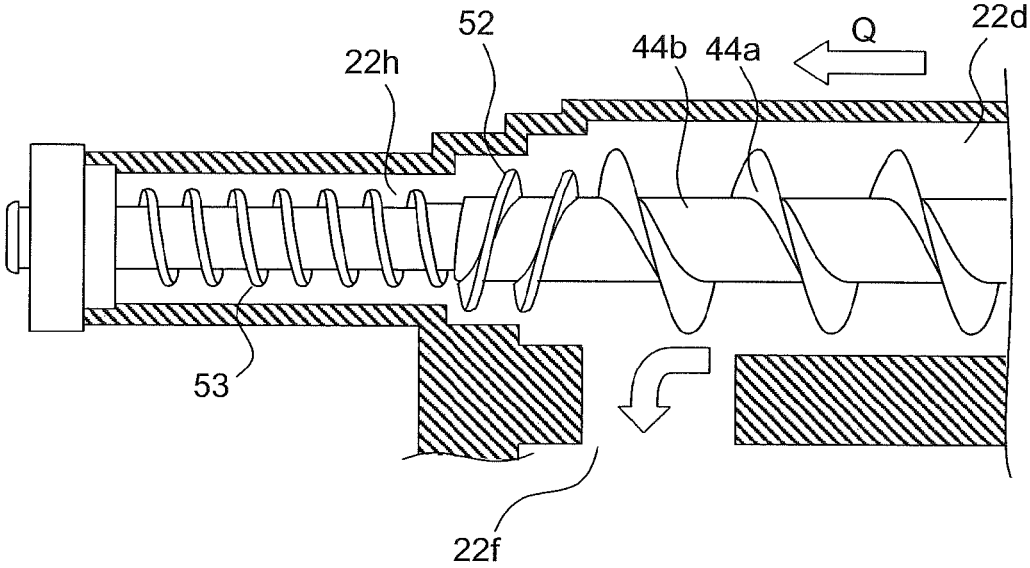
FIG. 4 is an enlarged view of and around a developer discharge port 22*h* in a developing device 2 according to one embodiment of the present disclosure.
Figure 5:
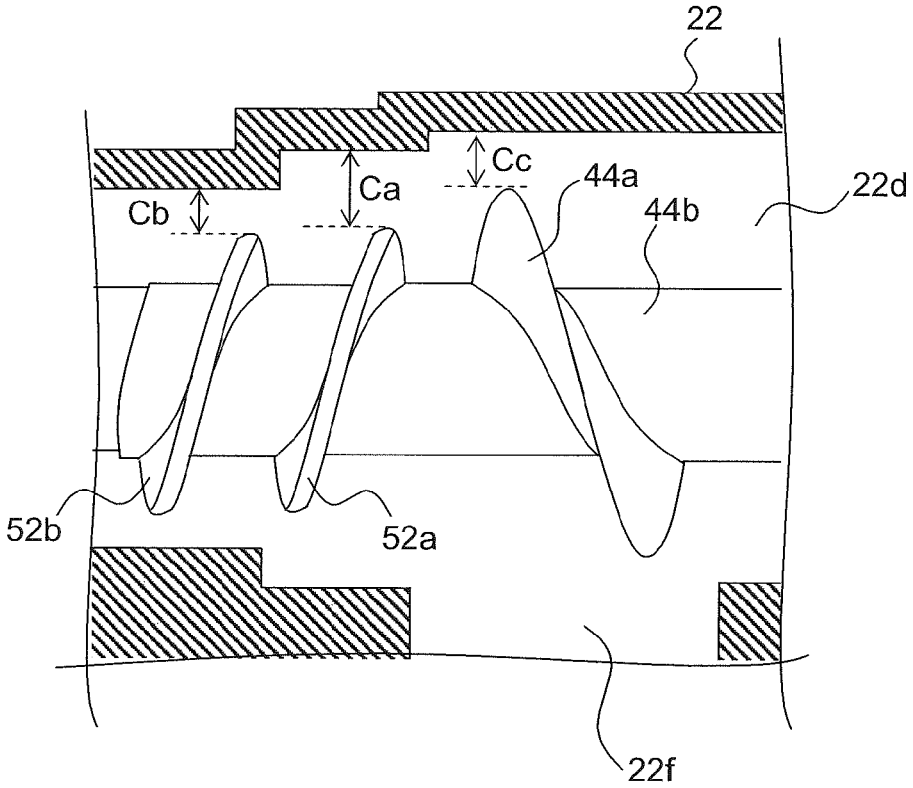
FIG. 5 is an enlarged view of and around a regulating portion 52 in FIG. 4.

FIG. 4 is an enlarged view of and around the developer discharge port 22*h* in the developing device 2 of the present embodiment; FIG. 5 is an enlarged view of and around the regulating portion 52 in FIG. 4. As shown in FIGS. 4 and 5, the regulating portion 52 is composed of a first regulating blade 52*a* having one turn (one phase) next to the second helical blade 44*a* and a second regulating blade 52*b* having one turn (one phase) next to the discharge blade 53. The first regulating blade 52*a* and the second regulating blade 52*b* have the same outer diameter. An inner diameter of a part of the developer container 22 facing the regulating portion 52 is gradually small from upstream to downstream with respect to the transport direction of the developer in the second transport chamber 22*d*.

With this structure, in this embodiment, with respect to the developer transport direction (the main transport direction, the direction indicated by arrow Q) in the second transport chamber 22*d*, let the gap (clearance) between the first regulating blade 52*a* on the upstream side and the inner wall surface of the developer container 22 be Ca, and let the gap (clearance) between the second regulating blade 52*b* on the downstream side and the inner wall surface of the developer container 22 be Cb, then the relation Ca>Cb holds.

In a region where the first regulating blade 52*a* is formed, the gap Ca is set relatively large, and this reduces the regulating force acting on the developer transported inside the second transport chamber 22*d* by the second helical blade 44*a*. As a result, although the developer continues to be transported in the main transport direction, the transport speed is reduced so that the developer stagnates, and this prevents ruffling (fluctuation) at the surface of the developer moving to the developer discharge port 22*h* and the downstream-side communication portion 22*f*. That is, the first regulating blade 52*a* serves to slow down the flow of the developer in the regulating portion 52.

In a region where the second regulating blade 52*b* is formed, the gap Cb is set smaller than the gap Ca so that a strong regulating force acts on the developer transported inside the second transport chamber 22*d*. As a result, a transporting force in the direction opposite to the main transport direction is applied to the developer. That is, by the second regulating blade 52*b*, a transporting force in the opposite direction is applied to the developer that has its flow slowed down by the first regulating blade 52*a*. In this way, the second regulating blade 52*b* serves to increase the height of the developer in the regulating portion 52, and to adjust the amount (discharged amount) of developer transported over the second regulating blade 52*b* to the developer discharge port 22*h*.

As described above, with the configuration according to the present embodiment, in the regulating portion 52, the transporting force for the developer in the main transport direction can be regulated in two steps. Even when the state of developer during transport in the developer container 22 changes according to fluctuation of the fluidity of developer, fluctuation of the toner concentration in the developer, fluctuation of the transport speed of developer, and the like due to variations in the environmental condition (temperature and humidity), no excessive developer is transported over the regulating portion 52 to the developer discharge port 22*h*, and this helps stabilize the amount of developer discharged through the developer discharge port 22*h*. Thus, even when the environment during use of the image forming apparatus 1 varies or when the process speed is changed, it is possible to keep the amount (stable volume) of developer in the developer container 22 substantially constant Moreover, in this embodiment, let the gap (clearance) between the second helical blade 44*a* and the inner wall surface of the developer container 22 be Cc, then the relation Ca>Cc holds. This helps sufficiently reduce the speed of the transport of the developer by the second helical blade 44*a* inside the second transport chamber 22*d* owing to the first regulating blade 52*a* having a larger gap from the inner wall surface of the developer container 22 than the second helical blade 44*a*.

Although the above-described embodiment deals with a case where the regulating portion 52 is composed of two turns of reverse helical blades, namely the first regulating blade 52*a* and the second regulating blade 52*b*, this is not meant as any limitation; instead of two turns, more than three turns of reverse helical blades may constitute the regulating portion 52. In that case, gaps between the reverse helical blades and the inner wall surface of the developer container 22 may be varied in more than three steps. Moreover, although in this embodiment the outer diameters of the first regulating blade 52*a* and the second regulating blade 52*b* which constitute the regulating portion 52 are made equal, and the inner diameter of a part of the developer container 22 facing the regulating portion 52 is made gradually small, instead, the inner diameter of a part of the developer container 22 facing the regulating portion 52 may be made equal and the outer diameter of the first regulating blade 52*a* may be made smaller than that of the second regulating blade 52*b* so as to fulfill the relation Ca>Cb.

The embodiments described above are in no way meant to limit the present disclosure, which thus allows for many modifications and variations within the spirit of the present disclosure. For example, the present disclosure is not limited to developing devices provided with a magnetic roller 21 and a developing roller 20 like those shown in FIG. 2; it is applicable to various developing devices that use two-component developer containing carrier and toner. For example, although the above-described embodiment deals with a two-shaft transport type developing device provided with a first transport chamber 22*c* and a second transport chamber 22*d* arranged parallel to each other as developer circulating passages in a developer container 22, the present disclosure is applicable also to a three-shaft transport type developing device provided additionally with a collecting transport chamber in which developer removed from a magnetic roller 21 is collected to be fed back to the second transport chamber 22*d*.

Moreover, the present disclosure is applicable, not only to tandem-type monochrome printers like the one shown in FIG. 1, but to various image forming apparatuses adopting a two-component developing system, such as digital and analog monochrome copiers, monochrome printers, color copiers, facsimile machines, etc. Below, by way of practical examples, the effects of the present disclosure will be described more specifically.

Practical Example 1

In the developing device 2 shown in FIG. 2, how the amount of developer in the developer container 22 varies as the gap between the regulating portion 52 and the developer container 22 was varied was examined. The experiment was performed in an image forming portion for black which included the photosensitive drum 11*a* and the developing device 2*a*.

In the experiment, as shown in FIGS. 4 and 5, the developing device 2 as the present disclosure had a gap Ca of 2.5 mm between the first regulating blade 52*a* and the inner wall surface of the developer container 22, and a gap Cb of 1.5 mm between the second regulating blade 52*b* on the downstream side and the inner wall surface of the developer container 22; by contrast, the developing device 2 as a comparative example had Ca=Cb=1.5 mm. The two developing devices 2 both had a gap Cc (see FIG. 5) of 1.5 mm between the second helical blade 44*a* and the inner surface of the developer container 22.

The second spiral 44 used in the present disclosure and the comparative example had the second helical blade 44*a* with an outer diameter of 14 mm, and had formed on it the regulating portion 52 composed of two turns of the first regulating blade 52*a* and the second regulating blade 52*b* spiraling in opposite directions with an outer diameters of 12 mm. The second spiral 44 also had formed on it the discharge blade 53 with an outer diameter of 8 mm spiraling in the same direction as the second helical blade 44*a*.

The developer container 22 (the first and second transport chambers 22*c* and 22*d*) contained 150 $cm^3$ of developer, and this amount was a predetermined amount with no surplus developer stored in the developer container 22. The toner concentration (the weight ratio of toner to carrier, T/C) in the developer stored in the developer container 22 was one of three levels of 8%, 10%, and 12%.

To determine variation in the amount of developer, the amount (stable volume) of developer was measured with the first spiral 43 and the second spiral 44 rotated at different rates of 200 rpm, 300 rpm, and 400 rpm. Table 1 shows the results.

TABLE 1

| STIRRING SPEED (rpm) | TONER CONCEN-TRATION (%) | STABLE VOLUME ($cm^3$) PRESENT DISCLOSURE | STABLE VOLUME ($cm^3$) COMPARATIVE EXAMPLE |
|---|---|---|---|
| 200 | 8 | 118 | 129 |
| 300 | 8 | 114 | 119 |
| 400 | 8 | 112 | 113 |
| 200 | 10 | 117 | 132 |
| 300 | 10 | 115 | 120 |
| 400 | 10 | 112 | 114 |
| 200 | 12 | 116 | 138 |
| 300 | 12 | 113 | 125 |
| 400 | 12 | 111 | 113 |

As will be clear from Table 1, in the developing device 2 according to the present disclosure, variation in the volume of developer in the developer container 22 was within 6 $cm^3$ as the stirring speed was varied from 200 rpm to 400 rpm at a constant toner concentration. Variation in the volume of developer was within 2 $cm^3$ as the toner concentration was varied from 8% to 12% at a constant stirring speed.

By contrast, in the developing device 2 of the comparative example, variation in the volume of developer in the developer container 22 was 25 $cm^3$ at the most as the stirring speed was varied from 200 rpm to 400 rpm at a constant toner concentration. Variation in the volume of developer was 9 $cm^3$ at the most as the toner concentration was varied from 8% to 12% at a constant stirring speed.

The above results confirm that in the developing device according to the present disclosure, where the gap between the two turns of regulating blades which constitute the regulating portion 52 and the inner wall surface of the developer container is gradually small in two steps from upstream to downstream with respect to the transport direction of the developer, as compared with a conventional structure, where the gap between the regulating blades and the inner wall surface of the developer container is constant, the stable volume of developer varies quite stably irrespective of the stirring speed or the toner concentration. Thus, by use of the developing device according to the present disclosure, it is possible to obtain stabilized developing performance and also to effectively suppress image defects and unnecessary discharge of developer.

The present disclosure finds application in developing devices incorporated in image forming apparatuses exploiting electrophotography, such as copiers, printers, facsimile machines, multifunction peripherals thereof, etc., and in image forming apparatuses provided with such developing devices. In particular, the present disclosure finds application in developing devices which can be replenished with new two-component developer containing toner and carrier and meanwhile discharge surplus developer, and in image forming apparatuses provided with such developing devices.

What is claimed is:

1. A developing device comprising:

a developer container having a plurality of transport chambers including a first transport chamber and a second transport chamber arranged parallel to each other, and communication portions through which the first and second transport chambers communicate with each other at opposite side end parts in a longitudinal direction thereof, the developer container containing two-component developer containing carrier and toner;

a first stirring member composed of a rotary shaft and a first helical blade formed on a circumferential surface of the rotary shaft, the first stirring member stirring and transporting the developer in the first transport chamber in an axial direction of the rotary shaft;

a second stirring member composed of a rotary shaft and a second helical blade formed on a circumferential surface of the rotary shaft, the second stirring member stirring and transporting the developer in the second transport chamber in an opposite direction to the first stirring member;

a developer carrier rotatably supported on the developer container, the developer carrier carrying on a surface thereof the developer in the second transport chamber;

a developer supply port through which the developer is supplied into the developer container; and a developer discharge port which is arranged in a downstream-side end part of the second transport chamber with respect to a developer transport direction in the second transport chamber, and through which surplus developer in the developer container is discharged, wherein the second stirring member has a discharge blade formed thereon which transports developer inside the developer discharge port in a same direction as the second stirring member, and has a regulating portion formed thereon which is arranged opposite the discharge blade on a downstream side of the communication portion arranged on a downstream side of the second transport chamber with respect to the developer transport direction in the second transport chamber, and which regulates movement of the developer toward the developer discharge port, the regulating portion is composed of two or more turns of regulating blades spiraling in an opposite phase to the second helical blade, and a gap between the regulating blades and an inner wall surface of the developer container is increasingly smaller from upstream to downstream with respect to the developer transport direction in the second transport chamber, the regulating blades are each composed of a first regulating blade having one turn and a second regulating blade having one turn which are arranged respectively on an upstream side and a downstream side with respect to the developer transport direction in the second transport chamber, and when a gap between the first regulating blade and the inner wall surface of the developer container is Ca, and a gap between the second helical blade and the inner wall surface of the developer container is Cc, then a relation Ca>Cc holds.

2. The developing device of claim 1, wherein outer diameters of the two or more turns of the regulating blades are equal, and an inner diameter of a part of the developer container facing the regulating blades is increasingly smaller from upstream to downstream with respect to the developer transport direction in the second transport chamber.

3. The developing device of claim 1, wherein let a gap between the second regulating blade and the inner wall surface of the developer container be Cb, then a relation Ca>Cb holds.

4. An image forming apparatus comprising the developing device of claim 1.

* * * * *